US006979225B2

(12) United States Patent
Solano

(10) Patent No.: US 6,979,225 B2
(45) Date of Patent: Dec. 27, 2005

(54) ELECTRICAL CONNECTOR WITH SEALABLE CONTACT INTERFACE

(75) Inventor: David William Solano, Troy, MI (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/789,856

(22) Filed: Feb. 27, 2004

(65) Prior Publication Data

US 2005/0191899 A1 Sep. 1, 2005

(51) Int. Cl.[7] ..... H01R 13/52

(52) U.S. Cl. ..... 439/519; 439/276

(58) Field of Search ..... 439/519, 276, 439/271

(56) References Cited

U.S. PATENT DOCUMENTS

| | | | | |
|---|---|---|---|---|
| 3,972,581 | A * | 8/1976 | Oldham | 439/201 |
| 4,425,017 | A * | 1/1984 | Chan | 439/276 |
| 5,639,992 | A * | 6/1997 | Debbaut | 174/84 R |
| 5,975,945 | A * | 11/1999 | Daoud | 439/519 |
| 6,364,692 | B1 * | 4/2002 | Okayasu et al. | 439/426 |
| 6,558,178 | B2 * | 5/2003 | Nakamura | 439/271 |
| 6,783,381 | B2 * | 8/2004 | Fukuda | 439/271 |

* cited by examiner

*Primary Examiner*—Hae Moon Hyeon

(57) ABSTRACT

A connector includes a housing having a mating face configured to join a mating connector. A contact held in the housing proximate the mating face. A gel material is provided on the housing between the contact and the mating face. The gel material includes a self-sealing slit formed in the gel material. The slit is configured to accept the mating connector. When the mating connector is removed, the slit closes to seal the contact.

19 Claims, 4 Drawing Sheets

ELECTRICAL CONNECTOR WITH SEALABLE CONTACT INTERFACE

BACKGROUND OF THE INVENTION

The present invention relates generally to sealed electrical connectors, and particularly to a receptacle terminal connector that automatically seals when disconnected.

Sealed electrical connectors are used in many areas, such as in the automotive industry, to protect electrical connections from moisture or other contaminants. Conventional connectors provide sealing only when mated and must be mated in a dry environment, such as an automotive assembly plant, to provide a sealed interconnection. When unmated in the field, the conventional connector is exposed to the environment and subject to contamination.

Many of today's vehicles are equipped with removable assemblies such as seats, consoles, entertainment systems, etc., that can be removed from the vehicle and later reinstalled by the vehicle operator. These removable assemblies may include electrical subsystems, such as power/heated seats, radios, and the like. The electrical subsystems may relate to operator comfort features, convenience features, entertainment features, navigation systems, or vehicle safety features, sensors or controls. When the assembly is removed, it is desirable to close or seal the electrical connector in the vehicle housing from environmental conditions. Sealing the connector prevents debris from plugging a receptacle and prevents water from reaching power and data contacts. When the electrical subsystem is reinstalled in the vehicle, it should function correctly even if the environment in which the connectors are mated is not completely dry.

Heretofore, separate seals or plugs were inserted into the connector in the vehicle housing. Hence, the operator manually inserted the plug once the assembly was removed and manually removed the plug before reinstalling the assembly. However, the seals and plugs are inconvenient and may be lost or damaged.

A need exists for a connector that automatically disconnects and reconnects when the operator removes and installs the assembly while maintaining a seal over the connector interface in the vehicle housing whether connected or disconnected.

BRIEF DESCRIPTION OF THE INVENTION

In one embodiment of the invention, a connector is provided including a housing having a mating face configured to join a mating connector. A contact is held in the housing proximate the mating face, and a gel material is provided on the housing between the contact and the mating face. The gel material includes a self-sealing slit formed in the gel material. The slit is configured to accept the mating connector. When the mating connector is removed, the slit closes to seal the contact. The connector also includes a dielectric member that accepts the contact. The dielectric member has an open face that is covered. The gel material may have surfaces that are cured to a rubber-like state.

The connector further includes an annular dielectric shell having a channel therethrough. The channel has a rear end that retains an annular seal configured to inhibit entry of fluid into the rear end. The connector includes a terminal position assurance (TPA) member and the gel material is sandwiched between the TPA member and the dielectric member.

In another embodiment of the invention, a connector assembly is provided including a plug holding a plug contact and a receptacle holding a receptacle contact. The receptacle has a gel material provided on the receptacle over a face of the receptacle. The plug contact pierces the gel material when the plug and receptacle are joined. The gel material re-seals when the plug contact is removed.

DETAILED DESCRIPTION OF THE INVENTION

Figure 1:
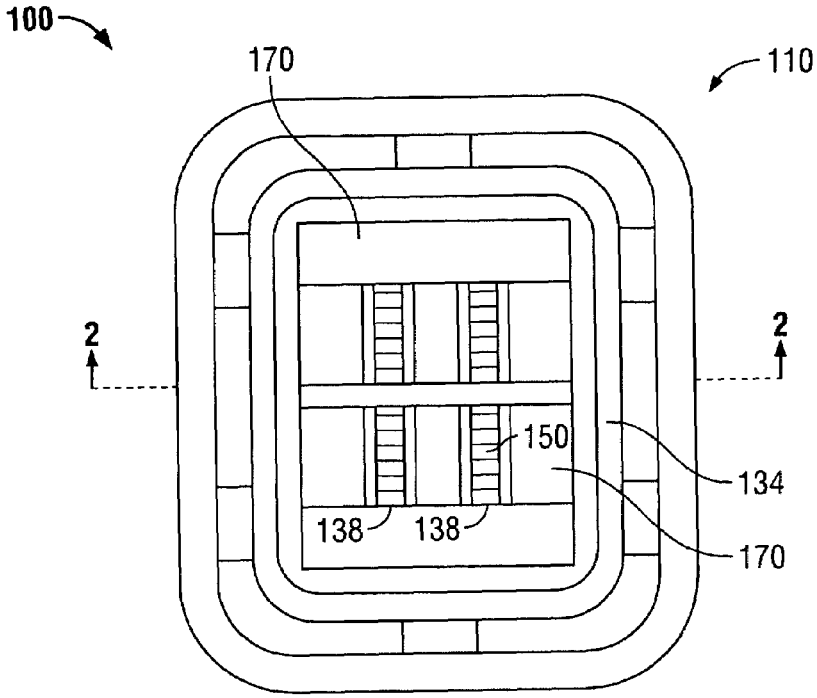
FIG. 1 is a front view of the mating face of a connector receptacle formed according to an embodiment of the present invention.
Figure 2:
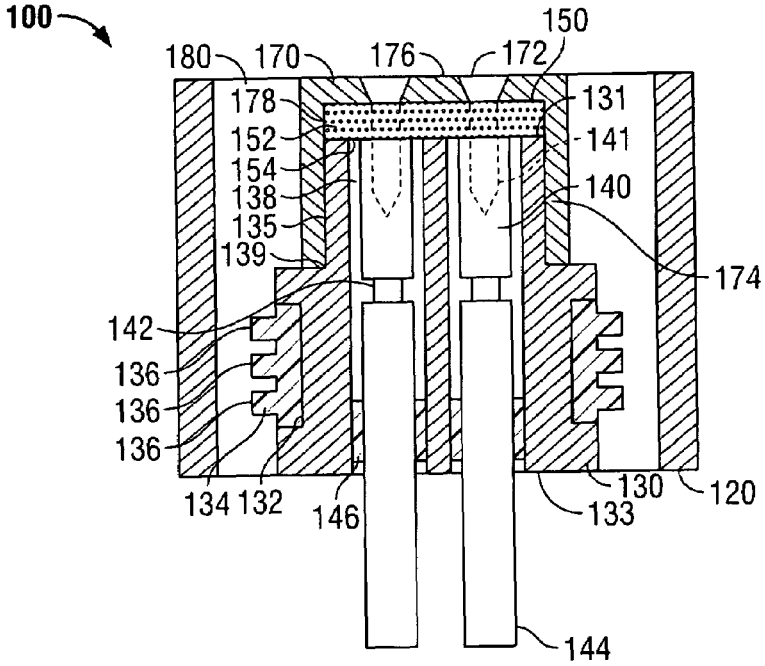
FIG. 2 is a cross sectional view of the receptacle of FIG. 1 taken along line 2—2 in FIG. 1.

FIG. 1 illustrates a front view of a sealed terminal receptacle 100. Receptacle 100 is shown in cross section in FIG. 2 and generally includes a housing 110 having an outer shell 120 surrounding a dielectric inner shell 130. Outer shell 120 and inner shell 130 are arranged concentric with one another and are separated by a gap 180. The inner shell 130 includes a channel 132 formed about the perimeter thereof. A seal 134 is carried in the channel 132 on inner shell 130. The seal 134 includes a number of ribs 136 formed about the perimeter of the seal 134. The ribs 136 are separated and partially extend into gap 180. Inner shell 130 includes an upper side wall 135 that forms a shoulder 139 above channel 132 on the perimeter of inner shell 130. The inner shell 130 has multiple chambers 138 that extend between front and rear ends 131 and 133, respectively, of the inner shell 130. The chambers 138 each receive an annular seal 146 provided about the wires 144 to seal chambers 138 at the rear end 133 near the entry of the wires 144 into the inner shell 130. In an alternative embodiment, the receptacle 100 could be provided with a multi-cavity rubber mat seal, along with a cover or wire-guide over the mat seal, as is known in the art, to seal the entry of the wires 144 at the rear ends 133 of the inner shell 130. Terminal contacts 140 are attached to the ends of conductors 142 extending from wires 144. Terminal contacts 140 have axially extending holes 141 (shown in ghost outline) for receiving a contact of a mating connector.

A gel material 150 covers the front end 131 of the inner shell 130 and contacts 140. Gel material 150 is a layer of about five millimeters in thickness between its upper surface 152 and lower surface 154. Gel 150 provides a re-enterable boundary that provides sealing when unmated, yet can be repeatedly penetrated to provide an electrical connection. The characteristics of gel material 150 are such that the material has the ability to flow sufficiently to conform to the surface of the penetrating object to form a watertight seal. However, gel material 150 does not bond to the penetrating object. The gel material 150 has sufficient structural integrity to avoid flowing into the chambers 138. One suitable gel material is available under the name GelTek™, formerly marketed by Raychem Corporation.

A terminal position assurance (TPA) member 170 is mounted over the top of contacts 140 and the front end 131 of inner shell 130. The TPA member 170 includes a top wall 176 and side walls 174 that extend over the upper side walls 135 of inner shell 130 so that gel material 150 is sandwiched between the lower surface 178 of the TPA member upper wall 176 and the upper ends of contacts 140 and inner shell front ends 131. The TPA member 170 is seated on the shoulder 139 of inner shell 130 and assures that mating connectors are properly aligned and positioned before the mating operation is performed. The TPA member 170 includes beveled openings 172 aligned with contacts 140 below gel material 150. In one embodiment, gel material 150 includes self sealing slits aligned with openings 172 in TPA 170. In an alternative embodiment, the gel material 150 could employ a more fully-cured, rubber-like "skin" on the surfaces. The skin would have less "tack" than the inner portion of the gel material 150. This skin would serve to reduce the adherence of small contaminants to the gel material 150 in the areas exposed through openings 172.

Figure 3:
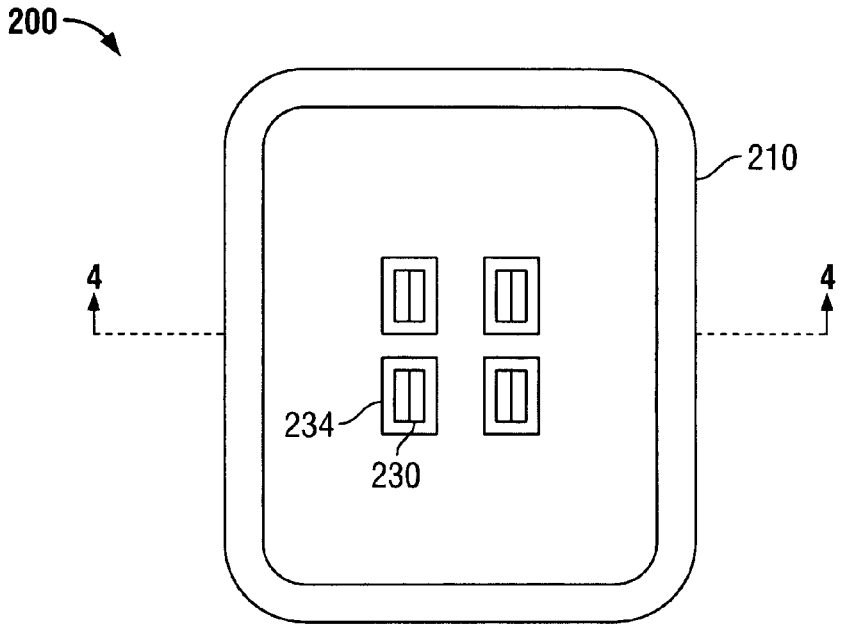
FIG. 3 is a front view of the mating face of a connector plug formed according to an embodiment of the present invention.
Figure 4:
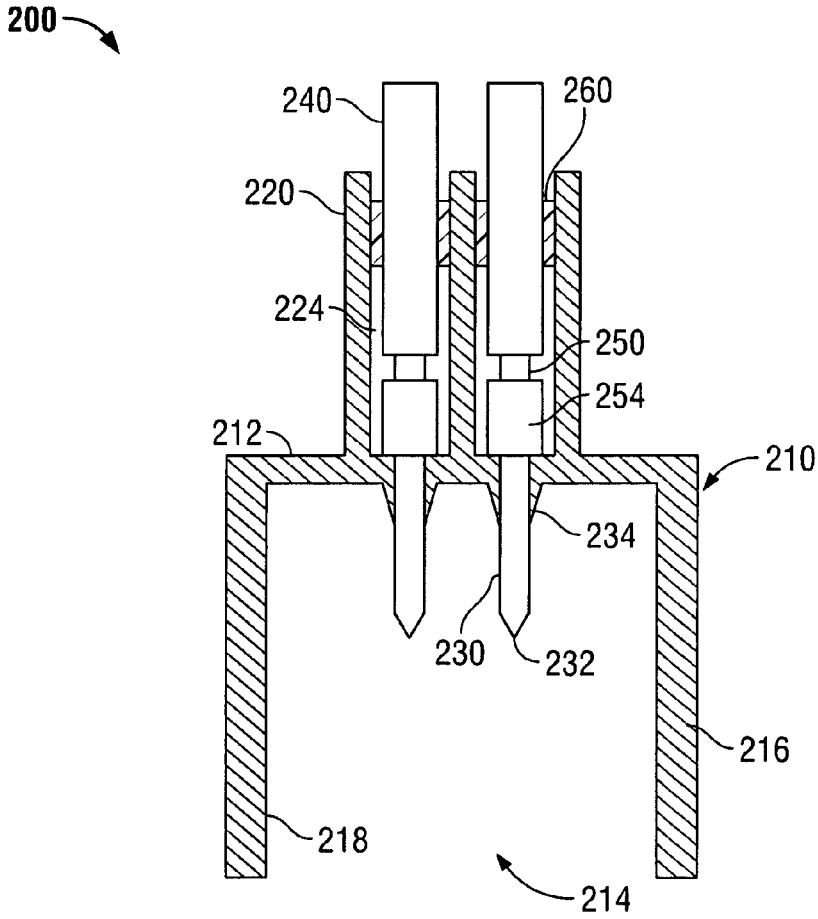
FIG. 4 is a cross sectional view of the connector plug of FIG. 3 taken along line 4—4 in FIG. 3.

FIGS. 3 and 4 illustrate a mating connector plug 200 suitable for use with receptacle 100. Connector plug 200 includes a shroud 210 that has a necked down portion 220, a shroud base 212, and a side wall 216 which has an inner surface 218. Wires 240 carrying conductors 250 are received in channels 224 in necked down portion 220 of shroud 210. Annular seals 260 are provided to seal wire receiving channels 224 in necked down portion 220. Conductors 250 are attached to internal contacts 254 within channels 224. Plug contacts 230 extend from inner contacts 254 through shroud base 212 and into the shroud opening 214. A chamfered edge 234 extends from shroud base 212 to cover a portion of plug contacts 230. Plug contacts 230 exhibit a beveled tip 232 for ease of insertion into a mating receptacle.

Figure 5:
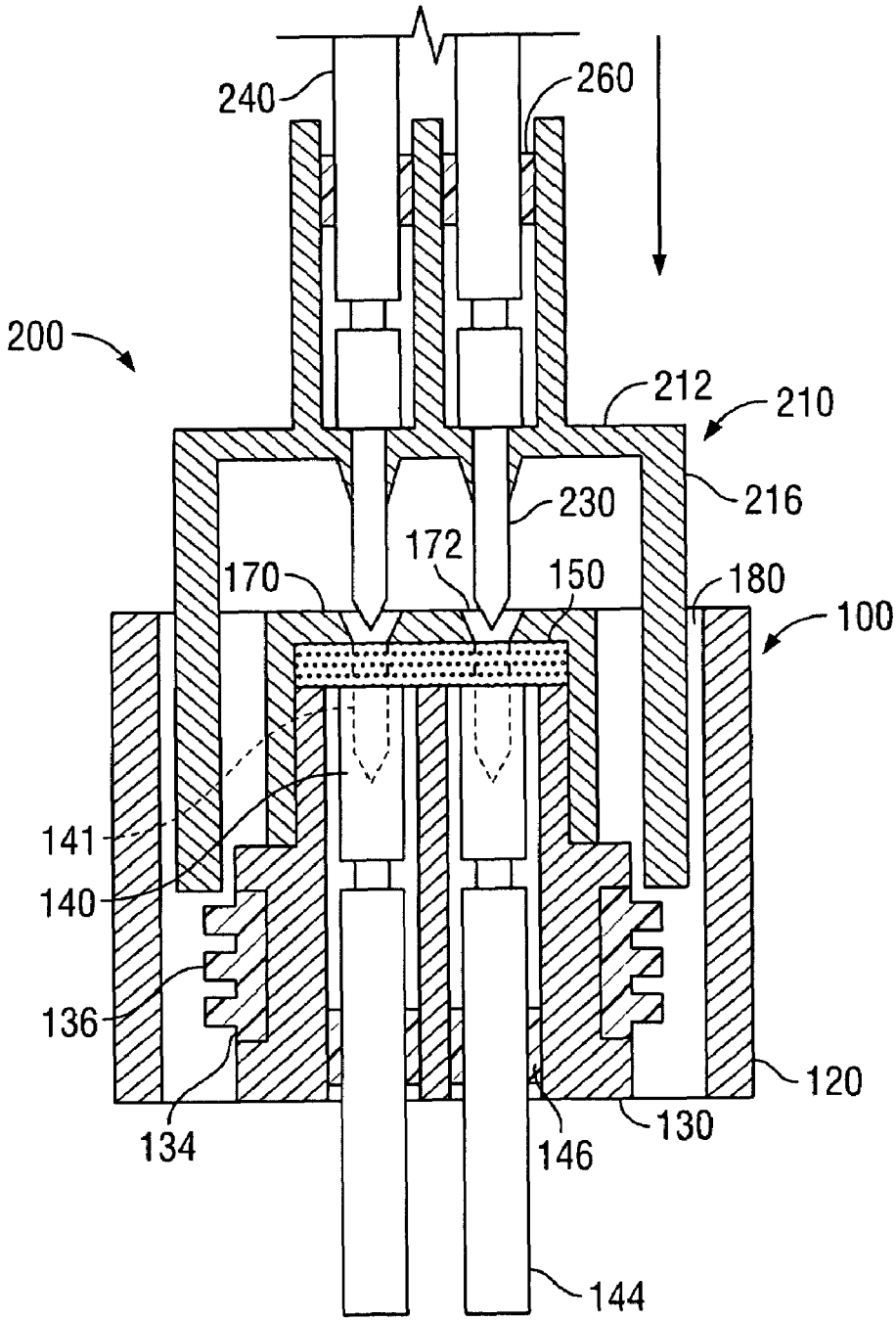
FIG. 5 is a cross sectional view of a plug and receptacle aligned to be mated and formed according to an embodiment of the present invention.

Next, a mating operation will be explained in connection with FIGS. 5 and 6. In FIG. 5, plug 200 is positioned to be mated with receptacle 100. Plug contacts 230 are positioned in line with beveled openings 172 in TPA member 170. Side wall 216 of shroud 210 extends into gap 180 between outer shell 120 and dielectric inner shell 130. As the connection is made, plug contacts 230 pierce gel material 150 and are received in contacts 140 in receptacle 100.

Figure 6:
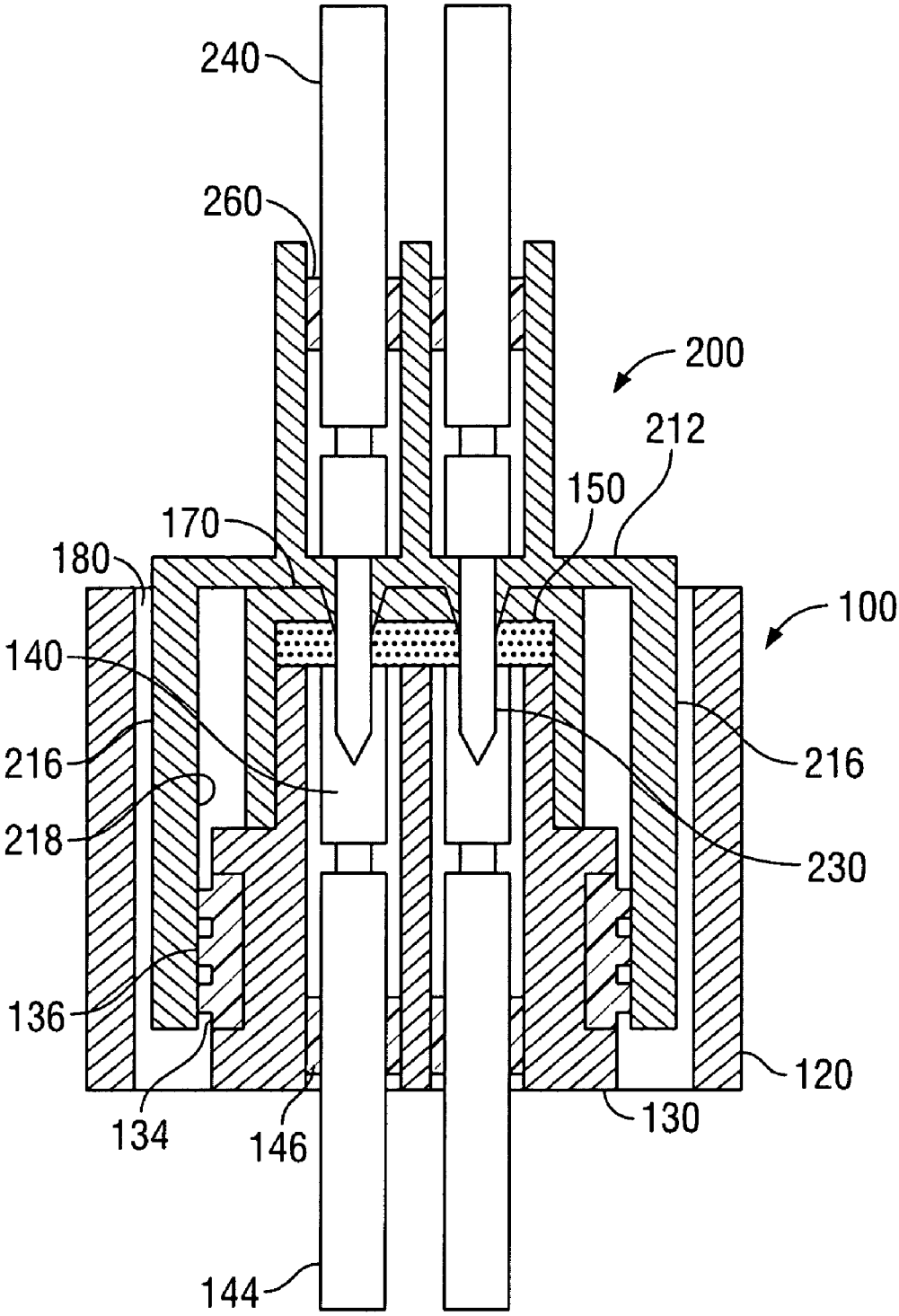
FIG. 6 is a cross sectional view of the mated plug and receptacle of FIG. 5.

In FIG. 6, a fully mated connection is illustrated. When fully mated, plug contacts 230 have pierced gel material 150 and are received in receptacle contacts 140. Shroud base 212 is abutted with TPA member 170. The inner surface 218 of shroud side wall 216 is shown engaged with and compressing ribs 136 of dielectric seal 134 and providing a sealed connection. When the connector is unmated, the plug contacts 230 are removed from the receptacle contacts 140, then withdrawn from the TPA member 170. Gel material 150 heals and receptacle 100 remains sealed.

Receptacle seals 146 and plug seals 260 operate to seal the rear ends of receptacle 100 and plug 200 to prevent entry of moisture or other foreign matter into the rear of the connector. Seals 146 and 260 are conventional seals that may be made of rubber or any other such material commonly used in the art. Alternatively, multi-cavity rubber mat seals, with a cover or wire-guide over the mat seal, could be used to seal the rear ends of receptacle 100 and plug 200.

The TPA member 170 is installed in such a manner that gel material 150 is maintained in a state of compression. This causes the gel material 150 to conform to the underside 178 of the TPA member top wall 176. Holding gel material 150 under compression enhances its ability to flow and close any openings therethrough which causes it to eject moisture and allows it to be used as a seal. When maintained under compression, gel material 150 allows a dry connection to be made even in a wet environment by conforming to the plug contacts 230 and repelling moisture. When the connector is unmated, the state of compression in gel material 150 allows gel material 150 to re-seal and the receptacle 100 remains sealed from water intrusion without the need for a separate cap or glove to cover the receptacle. The gel material 150 can either be pre-cured and placed in the mating face of the connector or the connector body can be "potted" with gel material 150.

Though described with a four contact connector, it is to be understood that receptacle 100 may contain any number of receptacle contacts with plug 200 including a like number of plug contacts.

While the invention has been described in terms of various specific embodiments, those skilled in the art will recognize that the invention can be practiced with modification within the spirit and scope of the claims.

What is claimed is:

1. A connector, comprising:

a housing having a mating face configured to join a mating connector, said housing comprising an outer shell and an inner shell disposed within said outer shell;

wherein said inner shell includes a contact receiving end and a wire receiving end, and a shoulder on an outer perimeter thereof, said inner shell further including a channel on said outer perimeter thereof between said shoulder and said wire receiving end, said channel receiving a seal;

a contact held in said housing proximate said mating face;

a gel material provided on said housing between said contact and said mating face, said gel material including a self-sealing slit formed in said gel material, said slit being configured to accept the mating connector and, when the mating connector is removed, said slit closing to seal said contact; and a terminal position assurance (TPA) member mounted over said contact and said gel material, said TPA member engaging said shoulder.

2. The connector of claim 1, wherein said contact is received in said inner shell, said inner shell having an open face covered by said gel material.

3. The connector of claim 1, wherein said gel material constitutes a planar layer of pre-cured gel placed over said mating face of said housing.

4. The connector of claim 1, wherein said inner shell includes a chamber therein, said chamber receiving said contact, said chamber having a rear end that retains an annular seal that is configured to prevent entry of fluid into said rear end.

5. The connector of claim 1, wherein said inner and outer shells are separated by a gap that is configured to accept an envelope of a mating connector, said inner shell having a mating end that is covered by said gel material.

6. The connector of claim 1, wherein said housing comprises multiple chambers therein that holds respective contacts, said gel material overlaying an open end of said chambers and having slits aligned and overlapping corresponding said chambers.

7. The connector of claim 1, wherein said TPA member has an opening therethrough aligned with said contact and said slit in said gel material.

8. The connector of claim 1, wherein said gel material is sandwiched between said TPA member and said inner shell.

9. The connector of claim 1, wherein said gel material has a plurality of separate and discrete slits formed therein, each of said slits being aligned with a corresponding one of a plurality of said contacts.

10. A connector assembly comprising:

a plug holding a plug contact;

a receptacle including a mating end and a wire receiving end, said receptacle holding a receptacle contact, said receptacle having a gel material provided on said receptacle over a face of said receptacle, said plug contact piercing said gel material when said plug and receptacle are joined, said gel material re-sealing when said plug contact is removed;

wherein said receptacle includes a shoulder between said mating end and said wire receiving end, said receptacle further including a channel thereon between said shoulder and said wire receiving end, said channel receiving a seal; and a terminal position assurance (TPA) member mounted over said receptacle contact and said gel material, said TPA member engaging said shoulder.

11. The connector assembly of claim 10, wherein said receptacle includes a dielectric member surrounding said receptacle contact, said plug having a shell that sealably encloses said dielectric member when mated.

12. The connector assembly of claim 10, wherein said gel material constitutes a planar layer placed over said face of said receptacle.

13. The connector assembly of claim 10, wherein said receptacle further comprises an annular dielectric shell having a chamber therein, said chamber receiving said receptacle contact, said chamber having a rear end that retains an annular seal that is configured to prevent entry of fluid into said rear end.

14. The connector assembly of claim 10, wherein said receptacle housing further comprises inner and outer shells separated by a gap that is configured to accept a shroud formed on said plug, said shroud surrounding said plug contact, said shroud being sealably received between said inner and outer shells.

15. The connector assembly of claim 10, wherein said receptacle retains multiple receptacle contacts and said gel material includes multiple corresponding slits overlaying said respective multiple contacts, said slits remaining closed in a fluid tight manner until mated with said plug.

16. The connector assembly of claim 10, wherein said TPA member has an opening therethrough aligned with said receptacle contact and a slit formed in said gel material.

17. The connector assembly of claim 10, wherein said gel material is sandwiched between said TPA member and said dielectric member.

18. The connector assembly of claim 10, wherein said gel material has a plurality of separate and discrete slits formed therein, each of said slits being aligned with a corresponding one of a plurality of receptacle contacts.

19. The connector assembly of claim 10, further comprising wires attached to said plug and receptacle contacts, respectively, said wires passing through rear openings in said plug and receptacle, said wires being surrounded by annular seals to form water tight seals between said wires and said plug and receptacle.

* * * * *